US005271642A

United States Patent [19]

Jahier et al.

[11] Patent Number: 5,271,642

[45] Date of Patent: Dec. 21, 1993

[54] MARKING LABEL FOR A PRODUCT

[75] Inventors: Christian Jahier, Nantes; Bertrand Bayart, St. Luce, both of France

[73] Assignee: Isocel, Sarl, Carquefou Cedex, France

[21] Appl. No.: 15

[22] Filed: Jan. 4, 1993

[30] Foreign Application Priority Data

Jan. 3, 1992 [FR] France ..... 92 00027

[51] Int. Cl.[5] ..... B42D 15/00

[52] U.S. Cl. ..... 283/81; 283/79; 283/101; 283/105; 40/299

[58] Field of Search ..... 283/79, 81, 101, 105; 40/299, 630; 428/40-43

[56] References Cited

U.S. PATENT DOCUMENTS 4,927,179 5/1940 Ehret et al. ..... 283/101 X 5,031,939 7/1991 Webendorfer et al. ..... 283/101 X

FOREIGN PATENT DOCUMENTS 4035095 6/1991 Fed. Rep. of Germany .

2210349 6/1989 United Kingdom .

*Primary Examiner*—Mark Rosenbaum

*Assistant Examiner*—Willmon Fridie, Jr.

*Attorney, Agent, or Firm*—Young & Thompson

[57] ABSTRACT

A marking label for a component product P to establish the physical movements thereof in the course of a production cycle in which this component product P is incorporated as a component of a composite product. The label comprising a single support having three parts (1, 2, 3) each provided with an identical identification code (4). A first of these parts (1) is a self-adhesive marking label of the component product P. A second of these parts (2) comprises a plurality of self-adhesive detachable identification tags (5) for the component product P. The third of these parts (3) comprises a self-adhesive label for the composite product and has marked thereon a plurality of target areas for the identification tags (5) not only of the mentioned component product P but also for other self-adhesive identification tags from other component products that make up the composite product.

7 Claims, 3 Drawing Sheets

MARKING LABEL FOR A PRODUCT

The present invention relates to a marking label for a product P as well as a process for tracing during production using said labels and permitting determining a posterior the origin, which is to say its composition, and the development, which is to say its involvement in the production of other products, of said product thanks to the course of the physical flow of the products taking place in the course of a production cycle.

The traceability in production is defined as the possibility of identifying the assembly of the products which enter into the composition of a finished product or the assembly of the finished products made from a same product. Thanks to this surveillance, it is possible when a finished product is defective to retrieve all of the finished products likely to have the same defect and also to detect the responsible supplier, as well as the responsible worker or industrial process.

This concept may well be considered to be impractical because it requires managing a large number of data (time, date of fabrication, machine number, raw materials) and must be undertaken in all steps of fabrication from raw material to the subassembly of level 1, from the subassembly of level N to the subassembly of level N+1, from subassembly N+1 to the finished product.

These existing processes are for the most part effected manually with the help of schedules, or of computer memories which, most of the time, are useless because they are impossible to control. Moreover, the requirement to be able to establish the origin of the product should ordinarily be adapted to be carried out for several years. This requires storage and retrieval from computer memories, from which there can be a substantial loss of time and production.

Another possibility consists in associating with a process of production a surveillance in real time to instruct the information system as to the physical flow of materials. This possibility, although desirable, is difficulty effected because it subjects the production tool to the operation of the computer, which most producers decline to do.

An object of the present invention is therefore to provide a marking label which contains data of a sufficient number to permit, by means of a control process of said labels, establishing a posteriori the list of the processes and component products which go into the production of an assembled product, or the list of the products produced from the same starting material, thanks to computerized supervision.

The invention thus relates to a marking label of a product P so as to establish the physical flow of said product during a fabrication cycle, characterized in that it has on a same support preferably three detachable portions (1, 2, 3) each provided with the same identification code, one of the portions (2 or 3) being adapted not to exist at the beginning or at the end of the fabrication cycle, the first portion constituting a marking label of the product P, the second portion comprising a series of detachable identification means of the product P and preferably self-sticking, adapted to be applied on the third part of similar labels of the products ultimately made from product P, the third portion having a reception area for the detached identification means of the second product label portion having served for the fabrication of the product P.

The invention also relates to a process for control of said labels, characterized in that each product is identified which takes place in a production cycle, by means of a label comprised preferably by three detachable parts, in that the label assembly is selected, corresponding to n products intervening between two predetermined production stages P1 and P2, in that, on said labels, there is detached each second portion constituted by a series of identification means, in that these are placed on the work station of stage P2, in that there is positioned on the third part of the label of the product produced in stage P2, n identification means from the n second portions of said selected labels, and in that the assembly of identification means is attached to the third part of the label of the product produced in step P2.

Other characteristics and advantages of the invention will become apparent from a reading of the description which follows and the accompanying drawings, which description and drawings are given only as examples. In these drawings.

Figure 1:
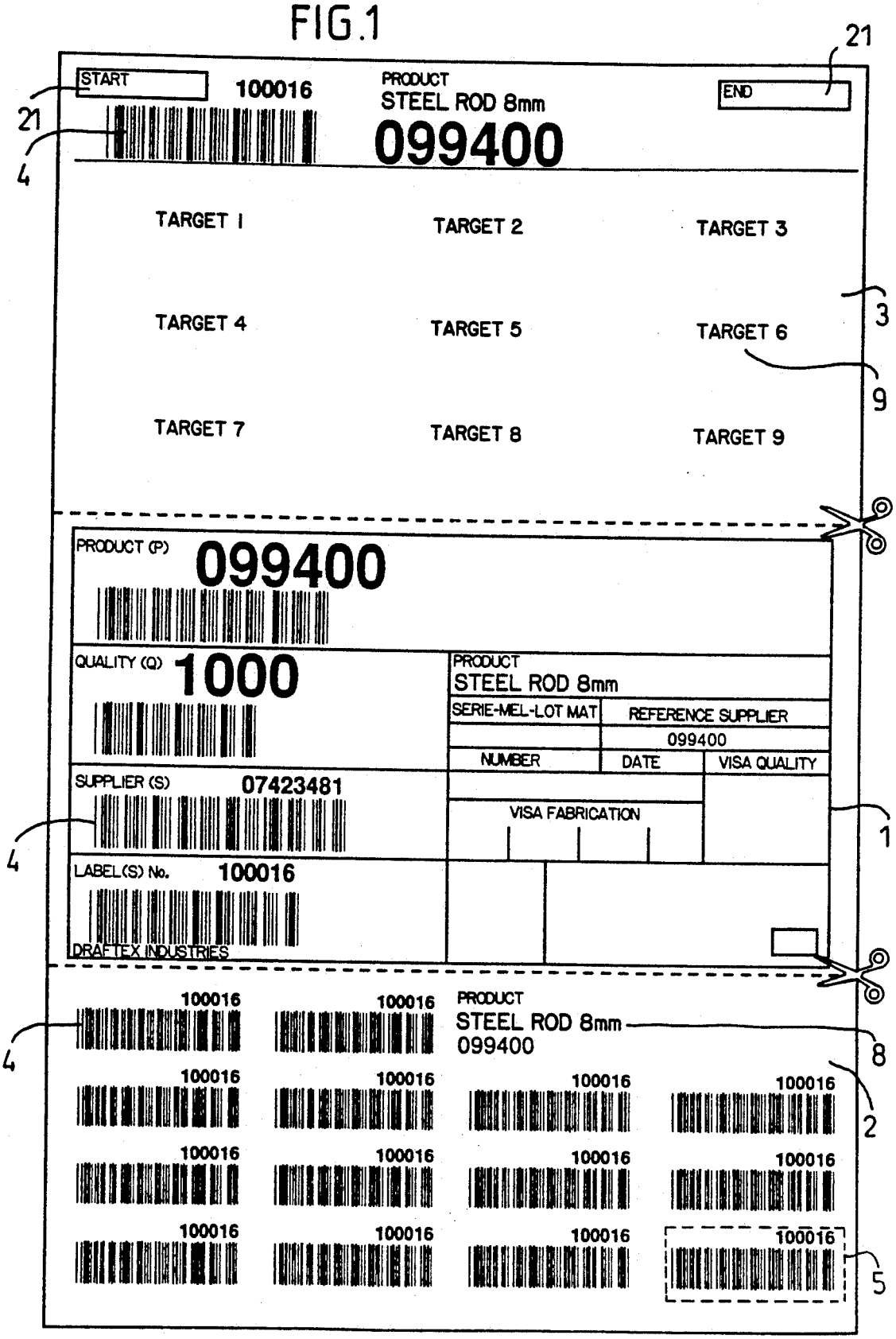
FIG. 1 shows a front view of a label not yet used, according to the invention.

According to FIG. 1, the marking label comprises preferably three parts 1, 2 and 3 adapted to be separated along the perforated lines and disposed on a common support. The three parts together bear a common identification code 4 which can be present in the form of a number, a bar code or may have any other form.

The first part of the label designated 1 is in fact the identification slip of the product or more particularly of the lot or parcel to which the product belongs. There is located on this part a certain number of data which can be very diverse as a function of the classifications chosen by the manufacturer. For example, there could be a notation as to quantity, product, or supplier permitting the identification of the supplier, which is important when there is a defect, and of course the identification code 4. This part 1 which can be more or less large in size is adapted to be applied to the lot and serve particularly when during the course of a manufacturing process all of the lot has not been used. This part 1 can be self-adhesive.

Figure 2:
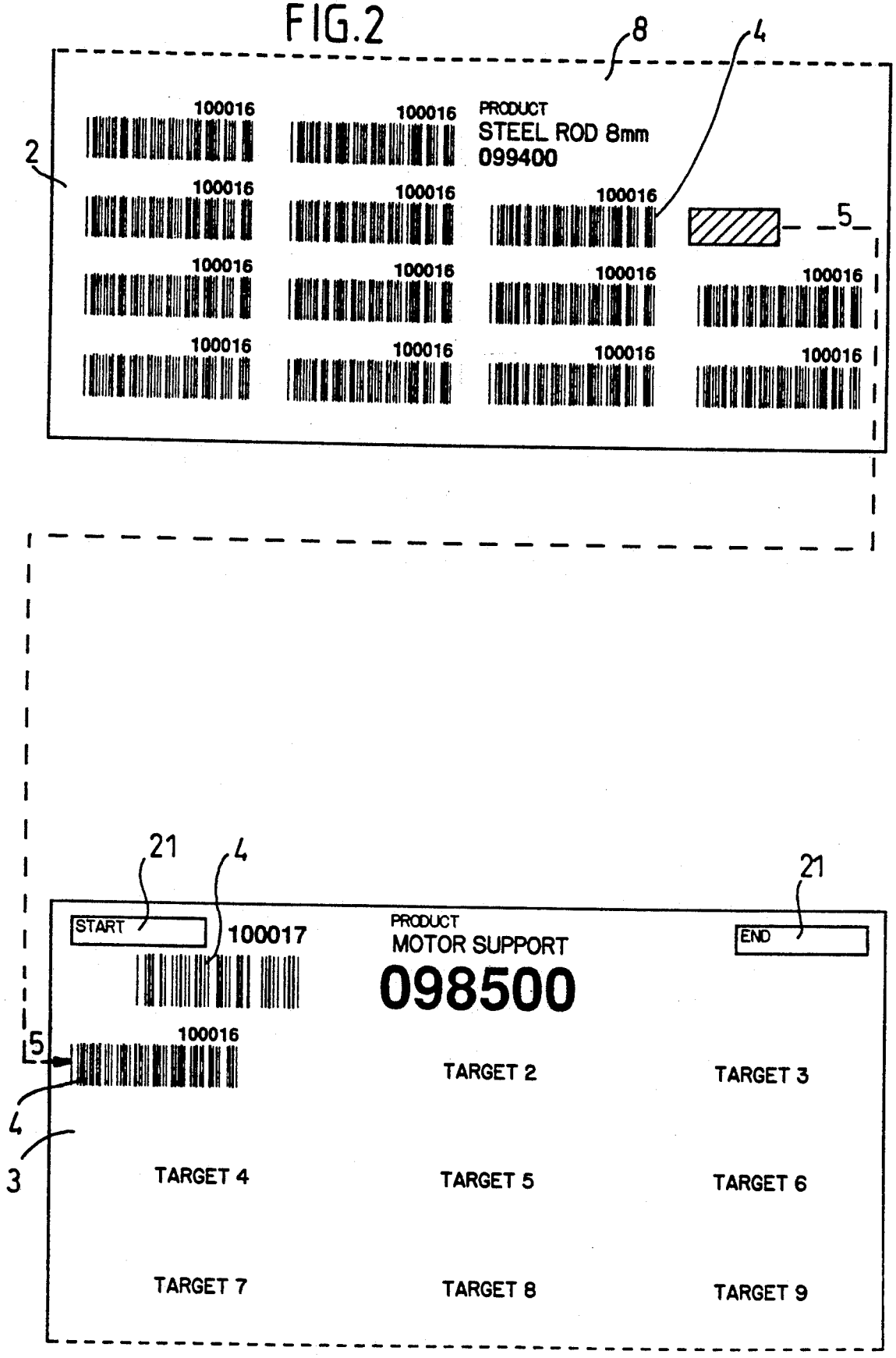
FIG. 2 shows the transfer of the identification means from the second portion of a label to the third portion of another label, being shown in frontal view.

The second part of the label designated 2 comprises a series of means for identification of the product P. These identification means are constituted by a label on which is disposed the identification code 4 of the product and are detachable from the support of part 2 so as to permit being transferred to another label as shown in FIG. 2. In general, to facilitate their separation from the support, these identification means 5 are self-adhesive. They could also be pre-perforated. One of the self-adhesive labels 8 of the part 2 comprises the name of the product such that the operator can verify that he is about to apply the proper identification means to his label.

Finally, the third part 3 of the label comprises a blank portion 9, a so-called reception area for identification means 5. This area serves to receive the identification means 5 detached from the part 2 of the labels marking the products taking part in the previous stages of the production process of the product P. FIG. 2 shows this transfer. In the example of FIG. 2, the upper part of the figure corresponds to the part 2 of an identification label of a steel rod product bearing the identification code of lot 100016. This product takes part in the production of a motor support product identified as 100017. The identification means 5 (100016) is therefore transferred to the part 3 of the label designating the motor support product as shown in broken line. Then, when all of the components of the motor support have been identified, the identification codes 4 will be recognized by the computer, using as entry the code 100017. This part 3 also comprises a certain number of indicia 21 concerned with the fabrication of the product. For example, on this part 3 can be mentioned the beginning and ending time of production, the machine utilized, the product in question, any interruptions in production, the identification code 4 of the product being already known to the computer by the number of the label of the lot, namely 100017.

Figure 3:
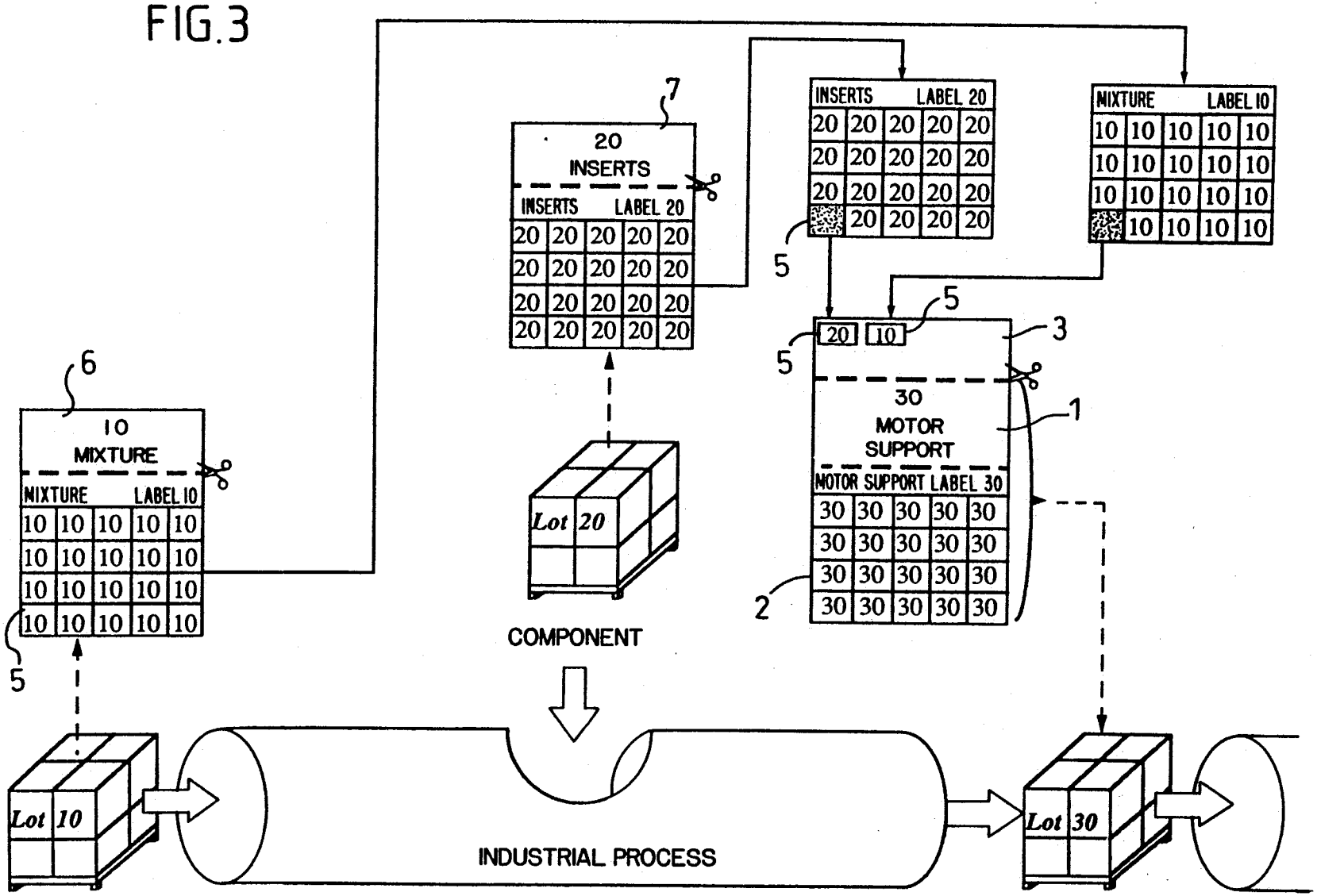
FIG. 3 shows the arrangement of the different stages of the process of control of the movement of the labels.

To be able to follow the path of the product P through a succession of stages of a production process, one proceeds according to the scheme shown in FIG. 3. At the outset, each product is identified of which it is desired to follow the movement through a production process by a label of the type described above. The process of production is broken down into stages between which there is established a surveillance of the products. For example, in the illustrated scheme, there is effected the surveillance of the step of transforming a lot 10 of starting materials into a subassembly constituted by the lot 30. In the course of this fabrication step, there is also used the lot of components 20. Before beginning the production process, the operator, who has identified the assembly of the lots before use in the course of this step, detaches all the parts 2 of the labels of said lots and regroups them at the work station situated at the end of the step when the lot 30 is completed. In the course of the production process, he will therefore detach an identification means 5 from the lot 10 of the part 2 of the corresponding label 6, and identification means 5 from the lot 20 of the part 2 of the corresponding label 7, and will apply these two identification means 5 onto the part 3 of the label of the lot 30 at the reception area provided for this purpose. When this production step is completed, the data 21 concerning the details of production (date and hour of beginning and of end of filling of the package, machine number, etc.), the part 3 of the label of lot 30 is detached and the information contained on the reception area is entered immediately or not into the computer and thus are stored. These data show that the lot 30 is produced from lots 10 and 20. Lots 10 and 20 are thus the parents of lot 30.

The rest of the label of lot 30 is constituted b parts 1 and 2. The part 1 is positioned on the package 30 to identify the lot and the part 2 is detached to serve in a final stage of production in which will be involved the lot 30. This part 2 will be used the same as the parts 2 of the labels of lots 10 and 20. If the lot 30 had constituted the finished product of the production process, in this case, the part 2 would be useless. This fact being foreseeable, it suffices during printing of said label not to order the printing of the part 2. For the same reasons, the printing of part 3 of the label of lot 10 need not be omitted, because it constitutes a lot of starting material, and so cannot have the products entering into its composition disposed upstream of the production line. On the contrary, for the lot 20, the three parts of the label suffice because the part 1 is applied to lot 20 and the part 3 can already have disappeared in the case in which the lot 20 has been produced from products disposed upstream of the fabrication process. Thus, this process permits operating in the ascendant or descendant direction, which is to say from the finished product to the starting product, or vice versa. In the example in question, it will be seen that the lot 30 is produced from lots 20 and 10 and that the inversion of lot 10 permits the fabrication of lot 30.

Thanks to the input to the computer, the storage of information is reduced to a minimum size. Moreover, the operations of sorting out permit obtaining rapidly the list of the products taking part in the production of a product or the list of products obtained from a starting material.

This process has a large number of advantages relative to manual control. It permits for example knowing which lots of produced products are in danger of having a flaw in the case of misfunction of a machine, because the number of the machine is associable with each final product. It also permits knowing that a lot has been produced from two lots of identical merchandise but of which one has been exhausted in the course of the production process. It also permits indicating a recycling of the products. This is the case for example when one lot was defective and becomes a starting material. Finally, it also permits verifying the work of the operator, which can have a label identical to the marking labels. This label is identical to the part 2 of the marking labels and the identification means 5 carries a corresponding identification code to the operator. This process permits finally verifying the quantity of merchandise supplied by the supplier; it is thus a remarkable statistical tool, both from a standpoint of the quality and of the quantity of starting data both relative to the quality and to the quantity of the work produced by the operator as well as with respect to the supplier. Moreover, it permits establishing in a sure manner that such defective product is a shortcoming of the lot of products A and as a result, X lots of products produced from lot A are in danger of having the same fault, the responsible supplier being Y. This process is a process for infallible product tracing.

We claim:

1. A marking label for a component product P to establish the physical movements of said component product in the course of a production cycle in which said component product P is incorporated as a component of a composite product, the label comprising a single support having three parts (1, 2, 3) each provided with an identical identification code (4), a first said part (1) constituting a marking label of said component product P and being detachable from said support, a second said part (2) comprising a plurality of identical self-adhesive detachable identification means (5) for said component product P, a third said part (3) comprising a label for said composite product and being detachable from said support, said third part (3) having marked thereon a plurality of target areas for said identification means (5) not only of said component product P but also for other self-adhesive identification means from other component products that make up said composite product.

2. A label as claimed in claim 1, wherein said identification code (4) is a bar code.

3. A label as claimed in claim 1, wherein said identification code (4) is a number.

4. A label as claimed in claim 1, wherein said first and third parts (1, 3) are self-adhesive.

5. A label as claimed in claim 1, wherein said second part (2) also bears the name of the component product P and a lot number.

6. A label as claimed in claim 1, wherein said third part (3) bears headings (21) for the time and data of manufacture.

7. A process for identifying component products P that take part in the manufacture of a composite product, comprising steps of providing a label formed of three parts each of which bears a same identification code (4), one of said parts (1) comprising a detachable marking label of said component product P, a second said part (2) comprising a plurality of identical detachable self-adhesive identification mean (5) for individual units of said component product P, and a said part (3) comprising a detachable label for said composite product, the method comprising detaching said first part (1) from said label and applying said first part to a solid surface for the identification of a plurality of said component products P, detaching said third part (3) from said label and applying said third part (3) to a solid surface to identify said composite product, said third part having individually-marked target areas thereon, and detaching from said second part a said identification means (5) and attaching the same to a said marked target area on said third part (3) thereby to indicate that said component product P forms a component part of said composite product.

* * * * *